US007860380B2

(12) United States Patent
Eisenbraun

(10) Patent No.: US 7,860,380 B2
(45) Date of Patent: Dec. 28, 2010

(54) VARIABLE VOLUME ENERGY SAVING WATER HEATER

(76) Inventor: Kenneth D. Eisenbraun, 1052 N. Glengerry Rd., Bloomfield Village, MI (US) 48301

( * ) Notice: Subject to any disclaimer, the term of this patent is extended or adjusted under 35 U.S.C. 154(b) by 389 days.

(21) Appl. No.: 12/172,749

(22) Filed: Jul. 14, 2008

(65) Prior Publication Data

US 2010/0006041 A1 Jan. 14, 2010

(51) Int. Cl.
*F24H 1/18* (2006.01)

(52) U.S. Cl. ..... 392/441; 392/449; 122/234

(58) Field of Classification Search ..... 392/441, 392/449

See application file for complete search history.

(56) References Cited

U.S. PATENT DOCUMENTS 3,621,566 A * 11/1971 Welsh ..... 29/610.1

4,409,958 A * 10/1983 Fillios ..... 122/14.1

* cited by examiner

*Primary Examiner*—Thor S Campbell
(74) *Attorney, Agent, or Firm*—Gifford, Krass, Sprinkle, Anderson & Citkowski, P.C.

(57) ABSTRACT

The present invention relates generally to apparatuses used for the heating of water and relates more specifically to water heaters in which the volume of water heated and stored may be fluctuated in response to the changing demand for heated water. The household demand for hot water depends on a variety of factors, including the number of people living in the household. It is therefore desirable to have a water heater in which the amount of water heated and stored may be varied so as to compensate for the changing hot water demand. The present invention is a variable volume water heater that can be used to accomplish this goal of matching the supply and demand of heated water.

16 Claims, 1 Drawing Sheet

VARIABLE VOLUME ENERGY SAVING WATER HEATER

FIELD OF THE INVENTION

The present invention relates generally to apparatuses used for the heating of water and relates more specifically to water heaters in which the volume of water heated and stored may be fluctuated in response to the changing demand for heated water.

BACKGROUND OF THE INVENTION

Conventional residential water heaters operate by constantly maintaining a fixed volume of heated water within a storage tank. These water heaters allow unheated water to enter an insulated storage tank until the tank contains the fixed volume of water. The water inside the tank is heated either through the combustion of a gas or by electrical resistance means. Since the heated water will float above any unheated water, a hot water outlet is typically located at the upper end of the storage tank. This hot water outlet allows water to exit the storage tank and be directed to appliances that require its use.

The problem with such conventional water heaters is their high consumption of energy. Because a fixed volume of heated water must always be maintained, the water in the storage tank must continuously be heated so as to maintain its temperature. Although insulation of the storage tank is partially effective in reducing the heat loss encountered by the stored water, additional energy is still required to keep the water at its hot temperature.

Because of the costs associated with this high consumption of energy, it is important that a water heater maintains only as much heated water as demanded by its users. The hot water demand of a household may depend on a variety of factors, such as the month of the year, or the number of people within the household. The demand can change, for example, as children grow up and leave the household or when members of the household leave to go on a vacation. It is therefore desirable to have a water heater in which the volume of water heated and stored may be increased or decreased in response to changes in the hot water demands of its users.

SUMMARY OF THE INVENTION

The present invention relates to a water heater in which the volume of water heated and stored may be increased or decreased in response to changes in the hot water demands of its users. In a preferred embodiment, the water heater comprises a water storage tank, a heat source for heating the water stored in the tank, a cold water input conduit allowing unheated water to enter the tank through a mechanically or electrically controlled valve, a warm water output conduit of variable length allowing heated water to exit the tank, a means for varying the length of said warm water output conduit to accommodate for different volumes of water storage within the tank, and a means for detecting the water level in the tank and for providing a signal indicative thereof for controlling the cold water input valve.

In a preferred embodiment, the warm water output conduit comprises two sections of pipe threadedly engaged with one another such that when the upper section of pipe is rotated relative to the lower section of pipe, depending on the direction of rotation, either the lower end of the lower section of pipe will extend deeper into the storage tank or the upper end of lower section of pipe will retract further inside the upper section of pipe. The user can actuate this rotation through use of a dial located on the outside of the water heater. The dial will facilitate the rotation of the two sections of output conduit pipe relative to each other by any electrical, mechanical, or electromechanical means. It should be noted that the use of the terms "upper" and "lower" are used simply to describe the telescoping action of the warm water output conduit and do not serve in any way to limit the structure of the invention.

In one embodiment, a sensor operable to detect the level of the water stored within the tank is disposed on the warm water output conduit. The sensor may embody several different forms. The sensor will provide an output signal when the water in the storage tanks comes into contact with the sensor. This output signal will trigger the cold water input valve to be closed off, not allowing any more water to enter the tank. While the sensor is not in contact with the water in the storage tank, the cold water input valve will remain open, allowing water to enter the storage tank. In this embodiment, changes in the length of the warm water input conduit will in turn alter the position of the sensor in relation to the water stored in the tank. This alteration of the sensor position serves to modulate the volume of water that will be stored in the tank by changing the water level that will trigger the opening and closing of the cold water input conduit. In another embodiment, the sensor may operate without the need for physical contact with the water in the tank. The sensor may be disposed anywhere on the interior or exterior of the water heater. The sensor controls the cold water input valve so that it opens when the water level falls below a desired level and closes when the water level reaches a desired level.

BRIEF DESCRIPTION OF THE DRAWINGS

Other objects, advantages and applications of the present invention will be made apparent by die following detailed description of a preferred embodiment of the invention. The description makes reference to the accompanying drawing in which.

DETAILED DESCRIPTION OF THE DRAWINGS

Figure 1:
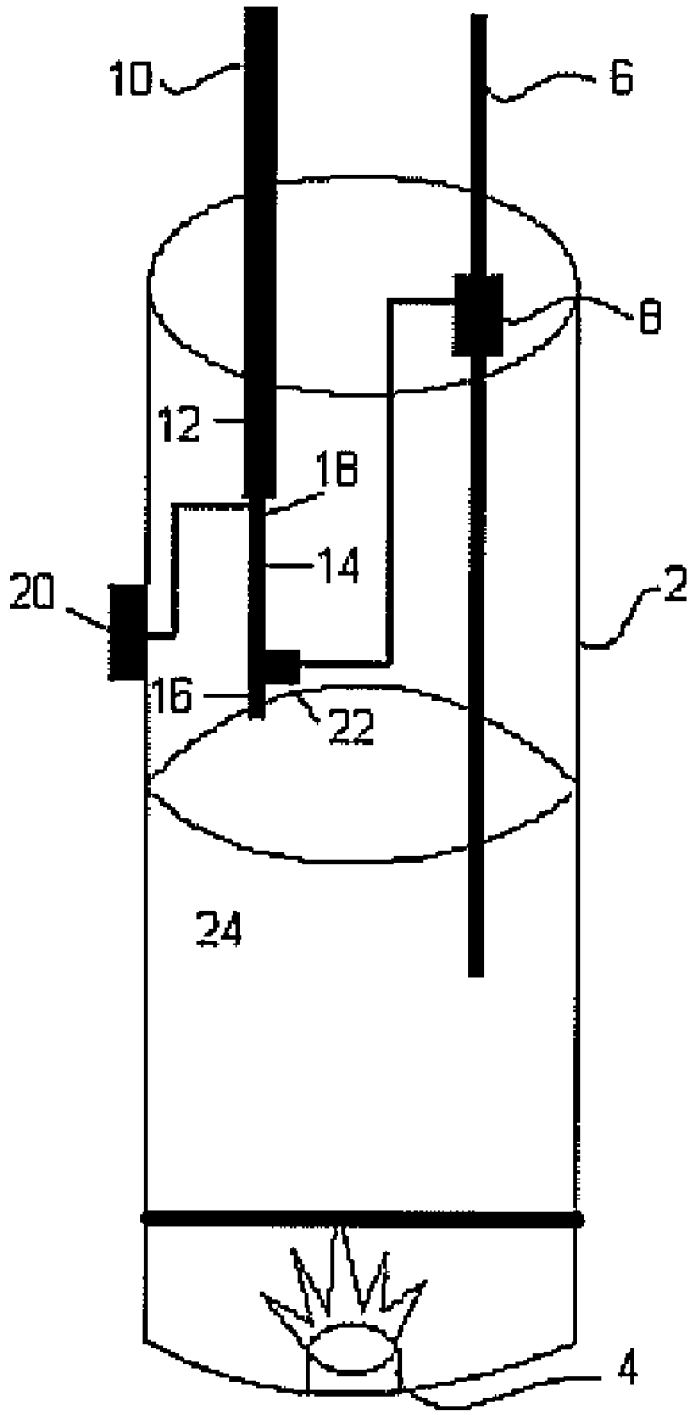
FIG. 1 is a cross-sectional view of a preferred embodiment for the variable volume water heater.

FIG. 1 depicts a cross-sectional view of a preferred embodiment of the present invention. The preferred embodiment comprises a water storage tank 2, a heat source 4 for heating the water stored in the tank, a cold water input conduit 6 allowing unheated water to enter the tank through a mechanically or electrically controlled valve 8, a warm water output conduit 10 of variable length allowing heated water to exit the tank, a means for varying the length of said warm water output conduit to accommodate for different volumes of water storage within the tank, and a means for detecting the water level in the tank and for providing a signal indicative thereof for control of the cold water input valve 8.

In the preferred embodiment depicted by FIG. 1, the warm water output conduit 10 comprises two sections of pipe threadedly engaged with one another such that when the upper section of pipe 12 is rotated relative to the lower section of pipe 14, depending on the direction of rotation, either the lower end of the lower section of pipe 16 will extend deeper into the storage tank or the upper end of lower section of pipe 18 will retract further inside the upper section of pipe 12. The user can actuate this rotation through use of a dial 20 located on the outside of the water heater. The dial will facilitate the rotation of the two sections of output conduit pipe relative to each other by any electrical, mechanical, or electromechanical means. It should be noted that the use of the terms "upper" and "lower" are used simply to describe the telescoping action of the warm water output conduit and do not serve in any way to limit the structure of the invention. The design of the variable length warm water output conduit need not be limited to the above-described embodiment. The warm water output conduit may instead comprise any other prior art conduit or pipe with extend able length.

In the preferred embodiment, a sensor 22 operable to detect the level of the water stored within the tank is disposed on the warm water output conduit 10. In the present embodiment, the sensor will provide an output signal when the water 24 in the storage tank 2 comes into contact with the sensor 22. This output signal will trigger the cold water input valve 8 to be closed off, not allowing any more water to enter the tank. While the sensor 22 is not in contact with the water 24 in the storage tank 2, the cold water input valve 8 will remain open, allowing water to enter the storage tank. In this embodiment, changes in the length of the warm water input conduit 10 will in turn alter the position of the sensor 22 in relation to the water 24 stored in the tank 2. This alteration of the sensor position serves to modulate the volume of water that will be stored in the tank by changing the water level that will trigger the opening and closing of the cold water input conduit. In another embodiment, the sensor may operate without the need for physical contact with the water in the tank. The sensor may be disposed anywhere on the interior or exterior of the water heater. The sensor controls the cold water input valve so that it opens when the water level falls below a desired level and closes when the water level reaches a desired level. The sensor may operate by optical, electromagnetic, mechanical, or electromechanical means. The sensor could in fact operate by measuring the weight of the water.

It is appreciated that the invention can incorporate other features standard in most prior art water heaters including, but not limited to, a thermostat or other means for controlling the temperature of the water, a valve or other means for controlling the pressure of the water, a means for venting any exhaust fumes resulting from the heating process, insulation around the storage tank to help prevent heat loss, or an anodic rod to reduce corrosion to other elements of the water heater.

While the above description discloses the preferred embodiments of the invention, it will be appreciated that numerous modifications and other embodiments may be devised by those skilled in the art. For example, it will be appreciated that features of the embodiments disclosed above can be used in various combinations and permutations. Therefore it will be understood that the appended claims are intended to cover the forgoing—and all other—modifications and embodiments that come within the spirit and scope of the present invention.

The invention claimed is:

1. A water heater comprising:

a water storage tank;

a heat source for heating the water stored in said water storage tank;

a cold water input conduit;

a controllable cold water input valve operable to open and close said cold water input conduit for allowing or preventing the flow of water into said water storage tank;

the cold water input conduit allowing unheated water to enter said water storage tank through said cold water input valve;

a warm water output conduit of variable length operable to allow heated water to exit said water storage tank;

an actuator operable to vary the length of said warm water output conduit to accommodate for different volumes of water storage within said water storage tank; and a sensor operable to quantify the amount of water stored in said water storage tank and to provide a signal indicative thereof for controlling said cold water input valve.

2. The water heater of claim 1 wherein said heat source is supplied by the combustion of a gas.

3. The water heater of claim 1 wherein said heat source is supplied by electricity.

4. The water heater of claim 1 wherein said warm water output conduit comprises a plurality of segments that telescope in and out of each other.

5. The water heater of claim 1 wherein said warm water output conduit comprises a plurality of segments that are threadedly engaged with one another.

6. The water heater of claim 1 comprising a dial located outside of the storage tank, said dial operable to vary the length of said warm water output conduit.

7. The water heater of claim 1 wherein said sensor is positioned on the warm water output conduit.

8. The water heater of claim 1 wherein said sensor is not positioned on the warm water output conduit.

9. The water heater of claim 1 wherein said sensor operates through measuring the weight of the water stored in the storage tank.

10. The water heater of claim 1 wherein said sensor operates through the transmission of electromagnetic waves.

11. The water heater of claim 1 comprising insulation placed around said storage tank, said insulation operable to reduce the heat loss of the storage tank.

12. The water heater of claim 1 comprising a thermostat operable to control the temperature of the water.

13. The water heater of claim 1 comprising a valve for controlling the pressure of the water.

14. The water heater of claim 1 comprising a valve for controlling the temperature of the water.

15. The water heater of claim 1 comprising a vent for evacuating any exhaust fumes generated by said heat source from the storage tank.

16. The water heater of claim 1 comprising an anodic rod operable to reduce corrosion to other elements of the water heater.

* * * * *